United States Patent [19]

Wilson, Jr.

[11] 4,203,095

[45] May 13, 1980

[54] MONITORING APPARATUS FOR DIRECT WIRE ALARM SYSTEM

[75] Inventor: Stanley Wilson, Jr., St. Charles, Mo.

[73] Assignee: Potter Electric Signal Co., St. Louis, Mo.

[21] Appl. No.: 856,278

[22] Filed: Dec. 1, 1977

Related U.S. Application Data

[63] Continuation-in-part of Ser. No. 722,409, Sep. 13, 1976, abandoned.

[51] Int. Cl.[2] ..... G08B 29/00

[52] U.S. Cl. ..... 340/506; 340/503; 340/502; 340/511; 340/661; 340/657

[58] Field of Search ..... 340/500, 502, 503, 506, 340/511, 537, 661, 657, 662, 663, 664, 517

[56] References Cited

U.S. PATENT DOCUMENTS

| | | | |
|---|---|---|---|
| 3,454,787 | 7/1969 | Gelernter | 340/662 |
| 3,582,925 | 6/1971 | Porter | 340/503 |
| 3,641,547 | 2/1972 | Reiss | 340/511 |
| 3,673,588 | 6/1972 | Riff | 340/663 |
| 3,786,501 | 1/1974 | Marnerakis | 340/511 |
| 3,801,972 | 4/1974 | Hokim et al. | 340/510 |
| 3,976,985 | 8/1976 | Schalow et al. | 340/657 |

*Primary Examiner*—John W. Caldwell, Sr.
*Assistant Examiner*—Donnie L. Crosland

[57] ABSTRACT

For monitoring the supervisory current in a communications line between a power source and a protected premises which forms a security protection circuit, monitoring apparatus utilizes sensitive solid state circuitry which appears transparent to the protection circuit. An operational amplifier input circuit protects the circuitry against component damage due to lightning, inherently rejects common mode errors due to noise, transients, and varying power supply voltage, and had an adjustable offset for line length compensation and circuit standardization. Voltage comparator circuitry indicates by digital signals the supervisory current level. After the operator conditions the apparatus for an abnormal current level which has been signalled, a lamp which blinks at a discernable rate is used to serve as a reminder of this state. Filtering circuitry detects and indicates the presence of a predetermined frequency oscillating current imposed in the communications line at the protected premises, producing a digital output. A plurality of such digital outputs may be conveniently processed by a microprocessor.

4 Claims, 2 Drawing Figures

MONITORING APPARATUS FOR DIRECT WIRE ALARM SYSTEM

REFERENCE TO RELATED APPLICATIONS

This application is a continuation-in-part of my prior co-pending application Ser. No. 722,409, filed Sept. 13, 1976, now abandoned.

BACKGROUND OF THE INVENTION

Monitoring equipment for security protection systems, of the type having a fixed voltage power source supplying current via a communications line to protected premises where the current may be varied to indicate a security breach, commonly utilizes electrical relays for automatic internal switching upon variation of the line current. These relays, though not easily damaged by high currents induced by lightning, have an inherent time delay and are not transparent to the remainder of the system.

Monitoring equipment using electronic solid state circuitry has been used, but has been subject to component damage from high currents induced by lightning and false reactions due to noise and transients. These may be eliminated by introduction of a resistor-capacitor filter which filters out short duration current signals, as in U.S. Pat. No. 3,252,156 to Muehter and U.S. Pat. No. 3,786,501 to Marnerakis, but any such filter reduces the security effectiveness of the equipment.

Regulatory groups, such as Underwriters Laboratories, Inc., require that security protection monitoring apparatus operate accurately even though its power supply voltage may vary widely. U.S. Pat. No. 3,786,501 to Marnerakis, which utilized operational amplifier input circuitry, does not recognize this problem, nor does it disclose a solution.

SUMMARY OF THE INVENTION

The principal object of the present invention is to provide fast, sensitive and reliable electronic solid state security protection circuitry for monitoring the current in a communications line from a central station to protected premises. Further purposes include reducing false circuit reactions due to noise, lightning-induced transients and power supply voltage variations, and protecting the circuit components from damage due to high currents induced by lightning. Another object is to provide circuitry suited for varied line lengths. Another object is to provide standardized circuitry having digital outputs which may be more conveniently monitored, or analyzed by a microprocessor or computer. Other purposes will become apparent from the detailed specification which follows.

Briefly summarizing, the invention utilizes a sampling resistor of low resistance relative to the total series resistance of the security system, connected in series with the communications line, to provide a voltage drop proportionate to the current in the line. Input circuitry utilizing an isolation circuit having high input impedance, to limit the input current, is coupled to the sampling resistor, producing a voltage level at its output equal to the sum of the voltage drop across the sampling resistor plus an offset voltage introduced to the isolation circuit. Preferably, the isolation circuit has sufficient common mode rejection to be nonresponsive to variations in power supply voltage and to reject noise and lightning-induced transients.

Sensitive electronic solid state voltage comparators compare the voltage level from the input circuitry to standardized reference voltages provided by a voltage divider network. The comparator's digital outputs indicate whether the voltage level exceeds the reference voltage corresponding to that output. By varying the offset voltage, the same standard reference voltages may be used for communications lines of varying length and for normal currents of varying amounts.

A lowpass filter, a rectifier and an operational amplifier together serve to produce a digital output when an oscillating current of predetermined frequency is detected by the input circuitry. Such an alternating current may be provided by apparatus at the remote premises to indicate an additional abnormal condition.

These digital outputs lend themselves to a number of signal processing methods. If a large number of such comparator outputs are to be utilized, they may be monitored by a microprocessor. Using a more conventional method, the outputs may be stored by holding registers and signals displayed to an operator, who may then condition the circuitry for differing line currents.

Such more conventional circuitry may display three distinct signals for each comparator output, instead of the conventional two. The third display signal may be a blinking light for indicating that the operator has conditioned the circuitry to operate normally while an abnormal line current is present.

DESCRIPTION OF THE PREFERRED EMBODIMENT

A central alarm station contains apparatus for monitoring the supervisory current in a permanently connected telephone line a, commonly referred to as a private line metallic circuit or a communications line. From the central station, a 130 volts d.c. grounded positive power source b, referred to as a fixed voltage power source, and which is conventional for security protection equipment, supplies power to the telephone line a. A 20 Hz alternating current voltage supply c is provided at the central station, to be switched onto the telephone line a at selected intervals as hereafter described. The central station will serve a plurality of telephone lines a with a single power source b, a single 20 Hz voltage supply c, and a single audible horn d. A variable resistor e is series connected in the telephone line to adjust the current level in the line when connecting the installation at the protected premises as to be described.

Figure 1:
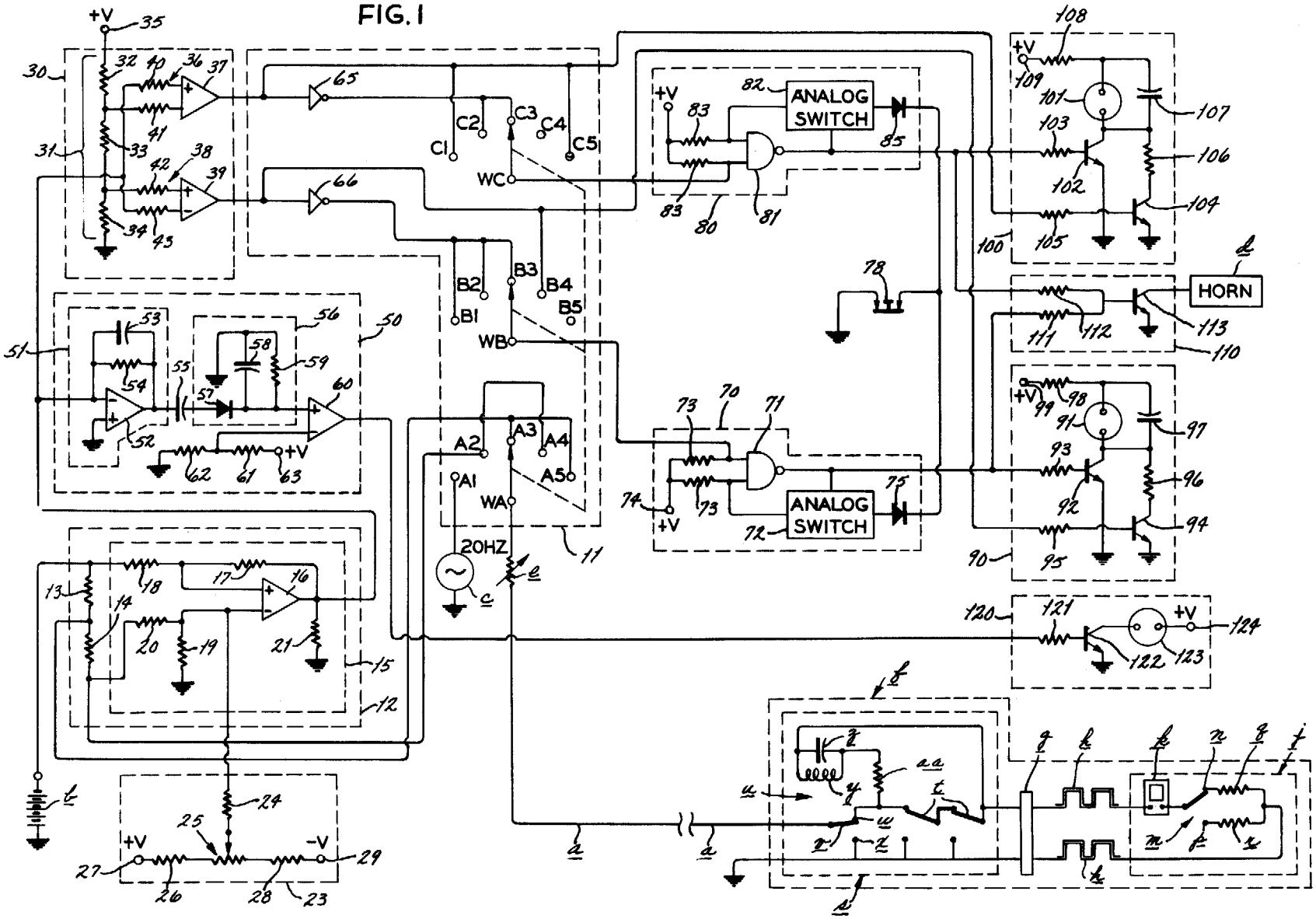
FIG. 1 is a circuit diagram of monitoring apparatus embodying the present invention shown including its installation in a telephone line from from protected premises.

The telephone line a, typically as long as 10 miles, is connected to protected premises, generally designated f, in FIG. 1, where conventional protective devices, such as a screen g or foil h, serve to open a protective circuit to decrease the current or cross a protective circuit to increase the current. At the premises a conventional subscriber's box, generally designated j, is utilized. It includes a buzzer k which is responsive to the 20 Hz voltage supply c at the central station. A two position switch, generally designated m, has a day contact n and a night contact p and is series connected to permit selection between a day resistor q and a night resistor r. The values of resistors q and r are chosen to set the current at 30 mA when through the day resistor q and 20 mA when through the night resistor r, when the protective devices g and h are in normal condition.

Included at the protected premises f is a conventional hold-up transmitter, generally designated s. The hold-up transmitter s has two hold-up switches t, which in normal position provide a current path to the subscriber's box through the other protective devices g, h, but, upon being switched by someone at the protected premises, the hold-up switches t provide a current path to ground. The hold-up transmitter s has a relay u, with its relay switch v connected to the telephone line a and switching between a first terminal w, connected through the protective hold-up switches t to the subscriber's box j, and a second terminal x connected to ground potential. The relay coil y, across which is connected a capacitor z, is connected through a resistor a-a to a point common to the hold-up switches t and the first terminal w of the relay u. The other terminal of the relay coil y is connected to the hold-up switches t at their terminal nearest the subscriber's box j.

The conventional hold-up transmitter s operates as follows:

The hold-up switches t normally provide a current path to the subscriber's box j. If a hold-up, or security breach, should occur, one or both of the hold-up switches t may be manually switched to that terminal connected to ground. This causes current to flow through the path of the resistor a-a, capacitor z and relay coil y. The resistor a-a has a resistance larger than that of the telephone line a or the day and night resistors q, r; being 7500 ohms, for example. Thus the current falls to a low value. As the current through the relay coil y builds up, the relay switch v switches from the first terminal w to the second terminal x; the current path is then directly to ground and the current increases to a high value. The energy stored in the relay coil y and capacitor z are dissipated through the resistor a-a. When the current through the relay coil y falls low enough, the relay switch v is again switched to the first terminal w and the current decreases to a low value. This oscillation continues to occur at a fixed frequency, herein 1 Hz, until the hold-up switches t are switched back to their normal position.

The monitoring apparatus of the present invention is, in the illustrated embodiment, installed at such central alarm station between the telephone line a and the power source b. Referring to FIG. 1, the telephone line a is connected to wiper contact WA of wafer A of a three-wafer, five-position manual rotary switch, generally designated 11. A contact A1 of wafer A is connected to the 20 Hz voltage source. Rotating the switch 11 with its wiper contact WA at contact A1, hereafter referred to as the ring position, causes the buzzer k at the protected premises f to be activated as a "ring" communication to it from the central station. The solid state input circuitry, generally designated 12, of the present monitoring apparatus has its first input connected to the negative side of the power source b. A second input of the input circuitry 12 is connected to contacts A3 and A5 of wafer A. A third input is connected to contacts A2 and A4 of wafer A. A 100 ohm sampling resistor 13 is coupled between the first and second inputs, and a 50 ohm sampling resistor 14 is coupled between the second and third inputs. Rotating wiper contact WA to A3 or A5 shunts the current through only the 100 ohm resistor 13, while rotating wiper contact WA to A2 or A4 shunts the current through the 100 ohm resistor 13 and the 50 ohm resistor 14 in series. The switch 11 is to be set for the series combination at night so that a normal night current of 20 mA produces a voltage drop of 3 volts. During the day the switch 11 is to be set for the 100 ohm resistor 13 only, so that a normal day current of 30 mA produces an equal 3 volt voltage drop.

The 100 ohm resistor 13 and the 50 ohm resistor 14 are small in value in comparison to the total resistance of the remainder of the telephone line circuit, typically 3,000–4,000 ohms. Thus, the present monitoring apparatus is practically transparent, having very little effect upon the current flow in the telephone line a. This desirable result was not possible with conventional relay circuits, which typically have an input resistance of 450 ohms. Where the sampling resistors are not greater than one-tenth the resistance of the remainder of the circuit, this effective transparency is achieved, and such resistors are referred to in the claims as low value sampling resistors.

As an addition to the embodiment illustrated in FIG. 1, a second set of such apparatus including sampling resistors along with the input circuitry 12 might also be located at the protected premises so that a watchman at the premises could likewise monitor the supervisory current. Simple modifications necessary for implementing such an alternative will be apparent to those skilled in the art. Since the monitoring apparatus 10 is practically transparent, the use of two such apparatuses 10 on one telephone line will not substantially affect the operation of the protection system.

An isolation circuit, generally designated 15, is coupled to the first and third inputs of the input circuitry 12. The isolation circuit 15 includes an input operational amplifier 16 having a feedback resistor 17 from its output to its noninverting input. The noninverting input is coupled through a first input resistor 18 to the first input of the input circuitry 12. The inverting input of the input operational amplifier 16 is connected to ground through a ground resistor 19 and to the third input of the input circuitry 12 through a second input resistor 20. A ground referencing resistor 21 from the output of the operational amplifier 16 is connected to ground.

In addition, at the inverting input of the operational amplifier 16 an adjustable offset voltage source 23 is provided. The offset voltage source 23 has a resistor 24 connecting the inverting input to the wiper terminal of a potentiometer 25. A second terminal of the potentiometer 25 is connected through a positive source resistor 26 to a positive d.c. voltage 27. The third terminal of the potentiometer 25 is connected through a negative source resistor 28 to a negative d.c. voltage 29. These voltages 27, 29 may be supplied by a typical low voltage bipolar power supply, such as the one which might be used to supply power to the operational amplifiers and the digital elements in the mounting apparatus 10.

The isolation circuit 15 produces at its output, which is the output of the input circuitry 12, a voltage level substantially equal to the sum of the voltage drop across its inputs plus the offset voltage introduced at its inverting input. The amplification afforded by the amplifier 16, is determined by the ratio of the value of feedback resistor 17 to the value of the first input resistor 18. In this embodiment these two resistors are substantially equal, and are likewise equal to resistors 19 and 20. This produces a voltage amplification of one to achieve the desired summing.

The value of these resistors must be quite large, for example 5 megohms, to achieve high input impedance for the input circuitry 12. It is desirable to have this high input impedance to reduce the power received by the input operational amplifier 16 due to high currents induced in the telephone line by lightning. This protects from damage both the input operational amplifier 16 and other circuits to which it is connected. Thus, sensitive electronic circuitry may be utilized for the remainder of the circuit. For purposes of the claims a high input impedance is defined as an impedance not less than one megohm.

The operational amplifier 16 is of the type having a large enough common mode rejection ratio to substantially reject noise and transients due to lightning. The common mode voltage of the operational amplifier 16, or the average of the voltage with respect to ground at its inverting and noninverting inputs, may vary from the normal 130 V d.c. Underwriters Laboratories standards require reliable operation over a wide variation of voltages. The operational amplifier 16 will increase the voltage level at its output when the common mode voltage increases, essentially creating an additional voltage component at its output proportionate to the common mode voltage. Such a common mode error might create a false alarm indication. Any noise, transients, or change in power supply voltage which appears as approximately equal voltages at both operational amplifier inputs will be rejected by an operational amplifier having a high common mode rejection ratio defined for these purposes as greater than 100,000.

The common mode rejection of the operational amplifier 16 is preserved to give the entire isolation circuit 15 a high common mode rejection ratio by having the values of the first and second input resistors 18, 20, the feedback resistor 17 and the ground resistor 20 substantially equal. Thus, the operational amplifier 16 is not amplifying, and the common mode error is not amplified.

The rejection of noise and lightning-induced transients is important. Conventional circuitry is likely to be falsely triggered by lightning-induced current pulses. Noise, in the form of induced alternating currents, is often present.

Other circuitry intended to reduce these false reactions may utilize a filter which has a time delay, which impairs the protection afforded. Very short current pulses often result from attempts by intruders to bridge the circuit; a circuit utilizing a time delay might filter out such pulses, while the isolation circuit 15 utilized here will accurately reflect them.

The output of the input circuitry 12 is connected to the input of comparator circuitry, generally designated 30, which compares the voltage level to reference voltages, producing at its digital outputs an indication of whether the voltage level exceeds the reference voltages.

The comparator circuitry 30 includes a voltage divider network, generally designated 31, having three resistors connected in series: a first dropping resistor 32, a second dropping resistor 33, and a third dropping resistor 34 connected to ground. The network 31 is connected to a positive d.c. voltage 35. The values of the positive d.c. voltage 35 and the dropping resistors 32, 33, 34 are so chosen that the common terminal of the first dropping resistor 32 and second dropping resistor 33 supplies a 3.8 V reference voltage and the common terminal of the second dropping resistor 33 and the third dropping resistor 34 supplies a 2.3 V reference voltage.

The comparator circuitry 30 includes a cross comparator 36 having a first operational amplifier 37 and an open comparator 38 having a second operational amplifier 39, such operational amplifier being of the type for which the output becomes the operational amplifier supply voltage when the voltage of its noninverting input exceeds the voltage at its inverting input, and is otherwise substantially zero volts.

The noninverting input of the first operational amplifier 37 is coupled through a resistor 40 to receive the voltage level from the output of the input circuitry 12. Its inverting input is coupled through a similar resistor 41 to receive the 3.8 V reference voltage from the voltage divider network 31. Thus the output of the cross comparator 36 is "high" when the voltage level exceeds 3.8 V.

The noninverting input of the second operational amplifier 39 is coupled through another similar resistor 42 to receive the 2.3 V reference voltage, while its inverting input is connected to the output of the input circuitry 12 through a resistor 43. The output of the open comparator 38 is "high" when the voltage level is less than 2.3 V.

Thus, there will be a digital output if the voltage level at the output of the isolation circuit 15 exceeds 3.8 V or falls below 2.3 V during the day or night. Its response to such changes is more sensitive and accurate than with conventional relay circuitry.

By changing the offset voltage applied to the inverting input of the operational amplifier 16 by the adjustable offset voltage source 23, the current levels in the telephone line a corresponding to the 3.8 V and 2.3 V voltage levels may be shifted. For example, for a 1 V offset, the comparator circuitry 30 will produce a digital output if the daytime current exceeds approximately 28 mA or falls below approximately 13 mA. If the offset were only 0.5 V, the daytime current limits would instead be approximately 32 mA and 18 mA, respectively. At nighttime, with a 1 V offset, the comparator circuitry 30 will produce a digital output when the current exceeds approximately 18 mA or falls below approximately 8 mA.

The offset voltage may be utilized for several purposes. By increasing the offset, compensation for the lower currents caused by the greater resistance of longer lines may be achieved. Thus, standardized reference voltages may be utilized for all feasible line lengths. In addition, the normal current level may be quite easily changed for security purposes. Furthermore, monitoring apparatus designed to operate at other normal current levels may utilize standard reference voltages by varying the offset voltage.

A hold-up detector circuit generally designated 50, also receives the output of the input circuit 12. The hold-up detector circuit 50 has an active lowpass filter 51 at its input, including a filter operational amplifier 52 with its noninverting input connected to ground potential and its inverting input serving as the input to the hold-up detector circuit 50. A parallel circuit consisting of a filter capacitor 53 and a filter resistor 54 serve as a feedback from the output of the filter operational amplifier 52 to its inverting input. The active filter 51 is coupled through a blocking capacitor 55 to a rectifier circuit, generally designated 56. The rectifier circuit 56 consists of a rectifier diode 57, its anode coupled to the blocking capacitor 55 and its cathode connected to the parallel combination of a rectifier capacitor 58 and a rectifier resistor 59, which is connected to ground potential. The output of the rectifier circuit 56, formed by the cathode of the rectifier diode 57, is connected to the noninverting input of an operational amplifier 60. The hold-up detector circuit 50 also includes a first resistor 61 in series connection with a second resistor 62 from a positive d.c. voltage 63 to ground potential. The inverting input of the operational amplifier 60 is connected to the common terminal of the first resistor 61 and second resistor 62.

The hold-up detector circuit 50 produces a digital signal when the input operational amplifier 16 receives the 1 Hz oscillating signal produced by the hold-up transmitter s. The active filter circuit 51 is a lowpass filter which passes alternating currents of only those frequencies equal to or less than 1 Hz, approximately corresponding to the frequency of oscillation of current from the hold-up transmitter s, which is about 1 Hz. The blocking capacitor 55 will allow only alternating currents to pass, and will block all direct currents. Thus it removes the d.c. component of the current monitered by the input circuit 12. The rectifier 56 transfers any alternating current which is passed through the active filter 51 of the blocking capacitor 55 into a direct current. This is achieved by the natural rectifying action of the diode 57 plus the resistor-capacitor combination 59, 58. The operational amplifier 60 serves to standardize the output of the hold-up detector circuit 50 at digital signal levels, for example, 5 V. If the magnitude of the voltage received at the noninverting input of the operational amplifier 60 is greater than the voltage supplied by the common terminals of the first and second resistors 61, 62 to the inverting input of the operational amplifier 60, its output becomes a digital "high".

The comparator circuitry 30 and hold-up detector circuit 50, both having a digital output, easily lend themselves to any of a number of methods for converting the indication of an abnormal current level to a recognizable indication of the specific abnormality present.

In the embodiment illustrated in FIG. 1 the output of the open comparator 38 is connected to contact B4 of wafer B of switch 11. A first inverter 65 couples contacts B1, B2 and B3 to the output of the open comparator circuit 38. thus, the switch 11 may be rotated so that wiper contact WB receives either the output of the open comparator 38 or its complement.

In a similar manner, the output of the cross comparator 36 is connected to contacts C1 and C5 of wafer C of switch 11. A second inverter 66 couples contacts C2 and C3 to the output of the cross comparator circuit 36. Thus, the switch 11 may be rotated so that wiper contact WC receives either the output of the cross comparator 36 or its complement.

The input of an electronic solid state open holding register, generally designated 70, is connected to wiper contact WB. The open holding register 70 has a conventional two-input NAND gate 71 whose output forms the output of the holding register 70 and is also connected to the gate of an analog switch 72. When the gate to the analog switch 72 is high, it permits current to flow through it; otherwise no current flows, NAND gate 71 has pull-up resistors 73 on each input, which are connected to a positive d.c. logic voltage 74, to hold the inputs to the NAND gate 71 "high" when there are no other inputs. One input to the NAND gate 71 is also connected to the input of the analog switch 72 whose output is connected through a diode 75 to a manual reset switch 78, described below. The other NAND gate input also forms the input to the open holding register 70.

When the input to the open holding register 70 becomes low, the output of the NAND gate 71 goes high, allowing current to flow through the analog switch 72 to diode 75 and the reset switch 78 to ground. Thus the other input to the NAND gate 71 becomes low. If the input to the holding register 70 should then go high, its output will nevertheless remain high, as a latched output.

The input of an electronic solid state cross holding register, generally designated 80, is connected to wiper contact WC. It has a two-input NAND gate 81, an analog switch 82, pull-up resistors 83, and a diode 85, connected in the same manner as the elements of the open holding register 70 and functioning in the same manner, being similarly connected to the manual reset switch 78 and a positive d.c. voltage 84.

The manual reset switch 78 is a normally closed momentary release switch connected between the diodes 75, 85 and ground. When the switch 78 is opened it causes those inputs of the NAND gates 71, 81 not forming the input to the holding registers 70, 80 to become high. If the input to the holding registers 70, 80 is high and the output is high, the output will now become low, unlatching the latched outputs. The diodes 75, 85 prevent one holding register from affecting the status of the other.

Instead of the combination of the NAND gates and analog switches to make up the holding register, conventional flip-flops or other electronic latching devices may be utilized, with conventional modifications in accompanying circuitry.

An open signalling circuit, generally designated 90, functions to display with its neon lamp 91 an indication of the current level in the telephone line a. The open signalling circuit 90 has a first transistor 92 whose emitter is connected to ground, to provide what is referred to as a first current path, and whose base is coupled to the output of the open holding register 70 through an input resistor 93. A similar second transistor 94 has its base coupled through an input resistor 95 to the output of the open comparator 38 and its emitter connected to ground. The collector of the second transistor 94 is coupled through a current-limiting resistor 96 to the collector of the first transistor 92. The combination of the second transistor 94 and the circuit-limiting resistor 96 is herein later referred to as the second circuit path. The collector of the first transistor 92 is connected to the parallel combination of the neon lamp 91 which is activated at 65 V, and a capacitor 97. The parallel combination is connected through a power source resistor 98 to a lamp driver power source 99.

When the base of the first transistor 92 is high, current is conducted through the first transistor 92, the power source register 98 and the parallel lamp 91 and capacitor 97 combination. The capacitor 97 charges until it reaches 65 V, when the lamp 91 goes on and discharges the capacitor 97, after which the lamp 91 goes off, and the cycle repeats itself. The values of the second current-limiting resistor 98 and the capacitor 97 are so chosen that the lamp 91 will blink on and off so fast that its off periods are not visually discernable, thus appearing to be constantly on.

When the base of the second transistor 94 is high, current is conducted through the second transistor 94, the current-limiting resistor 96 and the capacitor-lamp-power source resistor combination. The current-limiting resistor 96 is chosen with a much higher resistance value than the power source resistor 98. Thus if the first transistor 92 is meanwhile non-conducting, the lamp 91 will similarly blink, but at a much slower rate. The current-limiting resistor 96 is chosen to cause the blinking to be slow enough to be visually discernable.

If both transistors are conducting, the first transistor 92 essentially overrides the second transistor 94 by shunting the current-limiting resistor 96, and the lamp 91 again blinks so fast as to appear to be constantly on. When both transistor's bases are low, neither conducts and the lamp 91 is off.

A cross signalling circuit, generally designated 100, is a duplicate of the open signalling circuit 90, having its first transistor 102 forming a first current path, coupled through an input resistor 103 to the output of the cross holding register 80. Its second transistor 104, with an input resistor 105, is coupled to the output of the cross comparator 36. Similarly connected are a current-limiting resistor 106, a capacitor 107, a neon lamp 101, a power source resistor 108, and a lamp driver power source 109. The circuit functions identically to the open signalling circuit 90.

An audible driver circuit, generally designated 110, consists of a resistor 111 to the output of the open holding register 70 and a resistor 112 to the output of the cross holding register 80. Both resistors 111, 112 are connected to the base of a transistor 113 whose emitter-collector circuit drives the audible horn d. The horn d is thus on when either holding register 70, 80 has a latched output.

A hold-up signalling circuit, generally designated 120, receives the output of hold-up detector circuit 50, that output being formed by the output of its operational amplifier 60. The hold-up signalling circuit 120 has an input resistor 121 coupled to the base of a transistor 122, which has its emitter to ground potential. The collector of the transistor 122 is connected through a lamp 123 to a lamp driver voltage 124.

When the hold-up signalling circuit 120 receives a high output from the hold-up detector circuit 50, the transistor 122 conducts and the lamp 123 is lighted, to indicate a security breach.

For normal day operation of the monitoring apparatus, the rotary switch 11 is set with the wiper contacts WA, WB, and WC to contacts A3, B3, and C3 respectively, referred to as the day position. During normal night operation the wiper contacts WA, WB, and WC are rotated to contacts A2, B2, and C2 respectively, hereafter referred to as the night position. If a decrease in the current in the telephone line a sufficient to cause the output of the open comparator 38 to go high occurs, the output of the open holding register 70 goes high. Thus both inputs to the open signalling circuit 90 are high, and its lamp 91 appears to be on. In normal operation of the monitoring apparatus, an operator now rotates wiper contacts WA, WB, and WC of the rotary switch 11 to contacts A4, B4 and C4 respectively, hereafter referred to as the open position, and will push the normal reset switch 78. At that time if the output of the open comparator 38 remains high, the lamp 91 will blink.

If the open condition should be corrected, the input to the open holding register 70 would not become low, latching its output high and the lamp 91 will again be on and not blinking. To set the apparatus for normal operation, the operator rotates the rotary switch 11 back to the day position for normal day operation or the night position for normal night operation.

If an open condition should occur and be corrected before the operator rotates the rotary switch to the open position, he may turn off the lamp 91 and audible horn d by pushing the manual reset switch 78 to unlatch the open holding register 70. At the time the operator makes a determination of what may have caused the short duration open condition, drawing on his past experience.

Should an increase in the current in the telephone line a sufficient to cause a high at the output of the cross comparator 76 occur, the operator would act in a manner similar to his actions in dealing with the open condition, except that he would rotate the rotary switch to set the wiper contacts WA, WB, and WC to contacts A5, B5, and C5 respectively, hereafter called the cross position.

Previous apparatus for monitoring supervisory current did not utilize a blinking lamp to indicate that an abnormal current level is present for which the rotary switch has been set; the lamp simply was off. The added blinking lamp feature greatly improves operator convenience, by more clearly identifying the condition of the apparatus, allowing an operator to operate a greater number of such monitoring apparatus.

A simple alternative to this embodiment may simply include a latch with a reset switch and two transistor-driven lamps for each comparator, one lamp indicating the state of the output of the comparator and the other the output of the latch. Thus, indications of a prior abnormal current level and a present abnormal current level may be made. The specific circuitry will be apparent to one skilled in the art.

Figure 2:
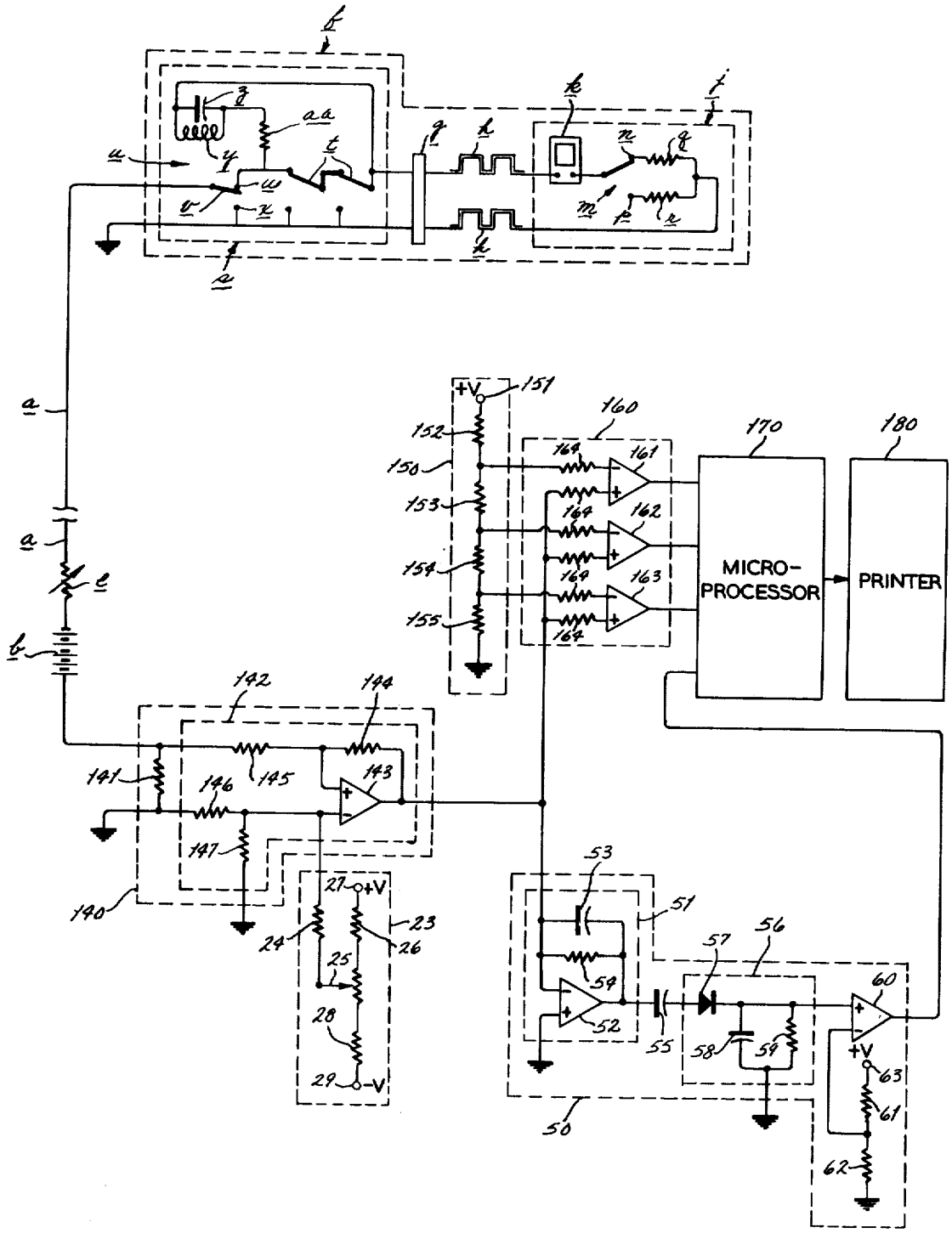
FIG. 2 is a circuit diagram of an alternate embodiment of the present invention.

An alternative embodiment of the present invention, illustrated in FIG. 2, utilizes a similar permanently connected telephone line a connected to protected premises, generally designated f. The grounded positive d.c. power source b supplies supervisory current down the telephone line a through the variable resistor e. Monitoring apparatus is connected between the power source and ground. This unconventional placement for the monitoring apparatus results in improved performance since the input circuitry, generally designated 140, is now operated near ground potential.

The input circuitry 140 utilizes a sampling resistor 141 having a low resistance with respect to the series resistance of the protective circuit, for example, 100 ohms, thus causing the monitoring apparatus to appear transparent. The remainder of the input circuitry 140 includes an isolation circuit generally designated 142, similar to the isolation circuit 15 of FIG. 1. The isolation circuit 142 utilizes an operational amplifier 143 with a feedback resistor 144 from its output to its noninverting input. Input resistors 145, 146 couple the inputs of the operational amplifier 143 across the sampling resistor 141. A ground resistor 147 connects the inverting input of the operational amplifier 143 to ground.

The values of the feedback resistor 144, input resistors 145, 146 and ground resistor 147 are substantially equal, sometimes referred to as matched, as are the similar resistors in the previous embodiment. Thus the isolation circuit 142 does not amplify, minimizing the common mode error of the operational amplifier 143.

This embodiment also includes a hold-up detector circuit 50, identical to the hold-up detector circuit 50 described in the previous embodiment. The hold-up detector circuit 50 is connected to the output of the operational amplifier 143 of the input circuit 140.

The input circuit 140 is also connected to an adjustable offset source 23, as in the first-described embodiment.

A voltage divider circuit, generally designated 150, has a d.c. voltage 151 connected to a first voltage divider resistor 152, a second voltage divider resistor 153, and a third voltage divider resistor 154, and a fourth voltage divider resistor 155, all in series with each other and to ground potential. The d.c. voltage source 151 and the voltage divider resistors 152, 153, 154, 155 are, for purposes of this embodiment, so chosen such that the common terminal of the first and second voltage divider resistors 152, 153 are maintained at 3.5 V, and the common terminal of the second and third voltage divider resistors 153, 154 is maintained at 2.5 V, while the common terminal of the third and fourth voltage divider resistors 154, 155 is maintained at 1.5 V.

Comparator circuitry, generally designated 160, is coupled to both the voltage divider circuit 150 and the input circuit 12. The comparator circuitry 160 has a first comparator operational amplifier 161 which has its inverting input connected through a comparator input resistor 164 to that point on the voltage divider circuit 150 which produces 3.5 V, being the common terminal of the first and second voltage divider resistors 152, 153. The noninverting input of the first comparator operational amplifier 161 is connected through a comparator input resistor 164 to the output of the input operational amplifier 16 of the input circuit 12. A second comparator operational amplifier 162 has its inverting input connected through a comparator input resistor 164 to that point on the voltage divider circuit 150 at which the second and third voltage divider resistors 153, 154 are connected, that point supplying 2.5 V. The noninverting input of the second comparator operational amplifier 162 is likewise coupled to the output of the input operational ampifier 16. A third comparator operational amplifier 163 has its inverting input connected through a comparator input resistor 164 to that point on the voltage divider circuit 150 at which the third and fourth voltage divider resistors 154, 155 are connected. It thus receives 1.5 V. The noninverting input of the third comparator operational amplifier 163 is connected to the output of the input operational amplifier 16.

In this described embodiment, the normal daytime current is 30 mA, normal nighttime current is 20 mA, and the sampling resistor 141 is 100 ohms. Since the input circuit 140 does not amplify, the normal voltage received by the comparator circuitry 160 during the daytime is 3.0 V and during the nighttime is 2.0 V. If the voltage is less than 1.5 V, it is considered an "open" condition. Then all the comparator operational amplifiers 161, 162, 163 have a low output. If the voltage is between 1.5 V and 2.5 V, it is considered to indicate normal nighttime current and only the third comparator operational amplifier 163 is high. If the voltage is between 2.5 V and 3.5 V, the second and third comparator operational amplifiers 162, 163 are high, indicating a normal daytime current. When the voltage exceeds 3.5 V, all the comparator operational amplifiers 161, 162, 163 are high. This indicates a "short" is present.

The three outputs of the comparator circuitry 160 formed by the outputs of the operational amplifiers 161, 162, 163 are connected to a data processor, which preferably consists of a microprocessor 170. The microprocessor 170, which also receives the output of the hold-up detector circuit 50, functions to manipulate the data inputted and drives a printer 180, which prints out the data indicating normal and abnormal conditions upon command.

The two above described embodiments are intended merely as examples incorporating the present invention and are not intended to limit scope. From the disclosure, variations and modifications will be apparent to persons skilled in the art.

I claim:

1. For use with a security protection system of the type having a fixed voltage power source supplying supervisory current via a communications line to protected premises at which protective devices serve to produce changes from the normal supervisory current level to a plurality of abnormal supervisory current levels, monitoring apparatus including A. means to produce a digital signal at an output on occurrence of an abnormal current level in the communications line, said means having an output for each of the plurality of abnormal current levels, B. a holding register means for each of said outputs, connected to receive the digital signal output and to indicate by a latched output that an abnormal supervisory current level has occured, C. selector switch means to set the monitoring apparatus either for a normal current level condition or for a selected one of a plurality of abnormal current level conditions, and D. a signalling circuit means associated with each said holding register means and its corresponding means to produce a digital signal on occurrence of an abnormal current level, each to produce three different displayed indications, one for each of three different states of the monitoring apparatus, each said signalling circuit means including a neon lamp having a voltage of activation, a capacitor connected in parallel with said lamp, a power source coupled to said lamp and capacitor, and supplying a voltage greater than the voltage of activation of the lamp, a first current path from said parallel connection of said lamp and capacitor, comprising a first transistor connected to said connection and being so connected to said holding register means as to be rendered conductive responsive to the latched output thereof, whereby when said first transistor is conductive, to charge said capacitor and light said lamp, together with a second current path from said parallel connection, comprising a second transistor so connected as to receive and be rendered conductive responsive to the digital signal output of said means to produce a digital signal to indicate an abnormal supervisory current level, resistor means in series with said second transistor and being of such value as to limit the current to a value insufficient to light said lamp, whereby, when only said second transistor is conductive, the capacitor charges slowly due to said resistor means and then discharges through the lamp to cause it to blink at a visually discernable rate, whereby the said three displayed indications are:

(1) said lamp is off, when said means to produce a digital signal has an output corresponding to a normal supervisory current level when set by said selector switch means for the normal condition; or (2) said lamp is lighted, when said holding register means has a latched output which is abnormal for the condition for which the apparatus is set by said selector switch means; or (3) said lamp blinks, when said holding register means has a latched output for that abnormal supervisory current level corresponding to the abnormal condition for which the apparatus is set by said selector switch means.

2. For use with a security protection system of the type having a fixed voltage power source supplying supervisory current via a communications line to protected premises at which protective devices serve to produce changes from the normal supervisory current level to a plurality of abnormal supervisory current levels, monitoring apparatus comprising input circuit means to produce a voltage level proportionate to the supervisory current, a plurality of comparator means, connected to receive such voltage level, each to produce a digital signal indicating whether the current level is normal or is one of such plurality of abnormal levels, a plurality of digital inverters, one coupled to each comparator means, to produce the complement of the digital signal, a plurality of digital holding register means, one operably related to each comparator means, manually positioned selector switch means interconnected between the comparator means, the coupled digital inverters, and the related holding register means, to select from each comparator means and its coupled inverter for transmission to its related holding register means, either the digital signal or its complement and by its selected position to indicate that the apparatus is set for the condition corresponding to such normal level or to that condition corresponding to a chosen one of such abnormal current levels, manual reset switch means for clearing the holding register means, whereby to permit the apparatus to be reset for determination of the present current level condition, and a plurality of signalling circuit means, one associated with each holding register means and its related comparator circuit means, each to so compare their digital states as to produce three different displayed indications, one for each of three different states of the monitoring apparatus, namely, that (1) the digital signal output of the comparator means corresponds to a normal supervisory current level when set by the manual selector switch means for the normal condition, or (2) the said holding register means has a latched output which is abnormal for the condition for which the apparatus was set by the manual selector switch and reset switch means, or (3) the holding register means has a latched output indicating that abnormal supervisory current level corresponding to the abnormal condition for which the apparatus is set by the manual selector switch and reset switch means.

3. For use with a security protection system of the type having a power source which supplies supervisory current via a communications line to protected premises at which a switch sets the supervisory current at one of a plurality of normal current levels and protective devices serve to produce changes from one of the normal current levels to one of a plurality of abnormal current levels, monitoring apparatus comprising A. input circuitry having a plurality of low-value sampling resistors for series connection in the communication line, selector switch means to select between the sampling resistors, the sampling resistors being of such relative values that by such selection between them an equal voltage drop is produced at every one of the normal supervisory current levels so set by the switch at the protected premises, and isolation means to produce a voltage level responsive to the voltage drop across the selected sampling resistors, and further comprising B. comparator circuitry connected to receive the voltage level and having (1) means for providing a plurality of different reference voltages, and (2) a plurality of comparator circuit means, one operably related to each different reference voltage, each to produce a digital signal output indicating whether the voltage level exceeds the reference voltage, whereby the digital signal output for each comparator means indicates either the normal or a selected abnormal current level, and further comprising C. means to convert the digital signal output to displayed indications of abnormal current levels in the communications line.

4. For use with a security protection system of the type having a power source which supplies supervisory current via a communications line to protected premises at which a switch sets the supervisory current at one of a plurality of normal current levels and protective devices serve to produce changes from one of the normal current levels to one of a plurality of abnormal current levels, monitoring apparatus comprising A. input circuitry having a plurality of low-value sampling resistors for series connection in the communications line, selector switch means to select between the sampling resistors, the sampling resistors being of such relative values that by such selection between them an equal voltage drop is produced at every one of the normal supervisory current levels so set by the switch at the protected premises, isolation means to produce a voltage level responsive to the voltage drop across the selected sampling resistors, and means to supply an adjustable offset voltage to the isolation means, whereby the isolation means responds to the offset voltage to shift the voltage level produced by the isolation means to correspond to a range of standardized reference voltages, the monitoring apparatus further comprising B. comparator circuitry connected to receive the voltage level and having (1) means for providing a plurality of different reference voltages, and (2) a plurality of comparator circuit means, one operably related to each different reference voltage, each to produce a digital signal output indicating whether the voltage level exceeds the reference voltage, whereby the digital signal output for each comparator means indicates either the normal or a selected abnormal current level, and further comprising C. means to convert the digital signal output to displayed indications of abnormal current levels in the communications line.

* * * * *